US009841152B2

(12) United States Patent
Stafford

(10) Patent No.: US 9,841,152 B2
(45) Date of Patent: Dec. 12, 2017

(54) TRAFFIC CONTROL LIGHT STRIP

(71) Applicant: Damian L. Stafford, Irvine, CA (US)

(72) Inventor: Damian L. Stafford, Irvine, CA (US)

( * ) Notice: Subject to any disclaimer, the term of this patent is extended or adjusted under 35 U.S.C. 154(b) by 0 days.

(21) Appl. No.: 15/170,663

(22) Filed: Jun. 1, 2016

(65) Prior Publication Data

US 2017/0097128 A1 Apr. 6, 2017

Related U.S. Application Data

(60) Provisional application No. 62/169,729, filed on Jun. 2, 2015.

(51) Int. Cl.

| | |
|---|---|
| ***F21L 4/00*** | (2006.01) |
| ***F21S 4/22*** | (2016.01) |
| ***F21V 23/06*** | (2006.01) |
| ***F21V 21/005*** | (2006.01) |
| ***F21V 7/00*** | (2006.01) |
| ***F21V 17/00*** | (2006.01) |
| ***F21S 9/02*** | (2006.01) |
| ***F21V 23/00*** | (2015.01) |
| ***H05B 37/02*** | (2006.01) |
| ***F21V 23/04*** | (2006.01) |
| ***E01F 9/20*** | (2016.01) |
| *F21Y 115/10* | (2016.01) |
| *F21Y 103/10* | (2016.01) |
| *F21W 131/103* | (2006.01) |
| *F21Y 113/13* | (2016.01) |

(52) U.S. Cl.

CPC *F21S 4/22* (2016.01); *E01F 9/20* (2016.02); *F21S 9/02* (2013.01); *F21V 7/00* (2013.01); *F21V 17/007* (2013.01); *F21V 21/005* (2013.01); *F21V 23/005* (2013.01); *F21V 23/04* (2013.01); *F21V 23/06* (2013.01); *H05B 37/0272* (2013.01); *F21W 2131/103* (2013.01); *F21Y 2103/10* (2016.08); *F21Y 2113/13* (2016.08); *F21Y 2115/10* (2016.08)

(58) Field of Classification Search

CPC ..... F21S 4/20–4/26; F21S 9/00–9/037; F21V 23/003–23/005; F21Y 2103/10

USPC ..... 362/157, 249.02–249.05

See application file for complete search history.

(56) References Cited

U.S. PATENT DOCUMENTS

| | | | | |
|---|---|---|---|---|
| 8,262,250 | B2 * | 9/2012 | Li | F21V 17/007 362/219 |
| 8,714,772 | B1 * | 5/2014 | Levante | F21V 23/06 362/217.17 |
| 9,383,073 | B2 * | 7/2016 | Frost | F21S 4/22 |

(Continued)

*Primary Examiner* — Seung Lee

(74) *Attorney, Agent, or Firm* — Roy A. Ekstrand

(57) ABSTRACT

A traffic control light strip supports a plurality of light emitting diode illumination devices within a plurality of LED units upon an elongated supporting strip. A power and control unit responsive to operator inputs is operatively coupled to the LED units to provide selective illumination patterns of the light emitting diodes. The traffic control light strip is supported by a flexible elongated base member which allows the entire traffic control light strip to be rolled upon a storage reel from a deployed configuration to a convenient storage configuration. In an alternate embodiment, the traffic control light strip includes a pair of extendable hinge coupled support members that facilitate folding the traffic control light strip to a closed transport and storage configuration.

12 Claims, 11 Drawing Sheets

(56) References Cited

U.S. PATENT DOCUMENTS

| | | | | |
|---|---|---|---|---|
| 2007/0291473 | A1* | 12/2007 | Traynor | A01K 11/00 362/106 |
| 2012/0182755 | A1* | 7/2012 | Wildner | G09F 9/301 362/555 |

* cited by examiner

Fig 2B
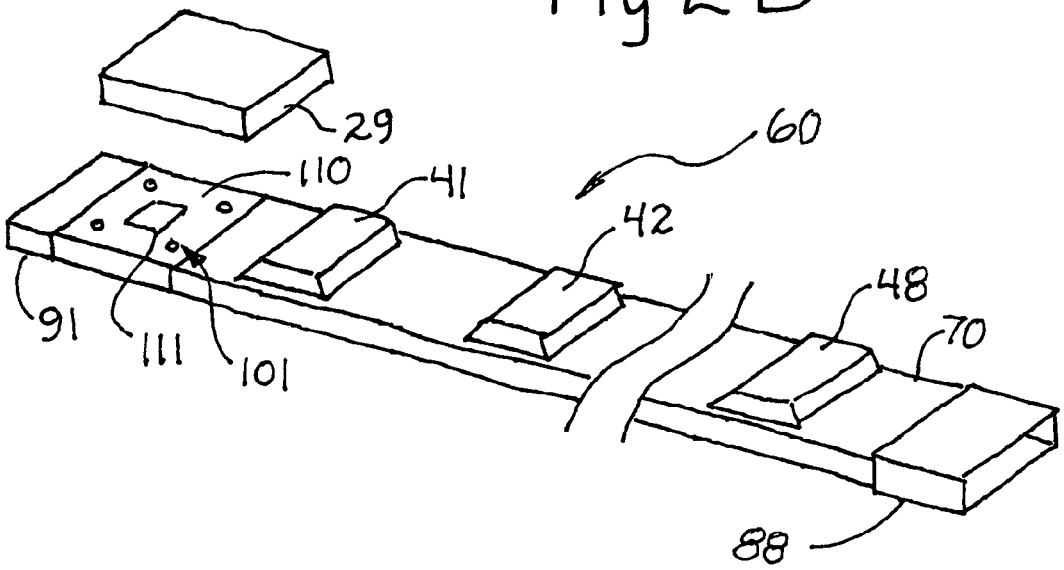
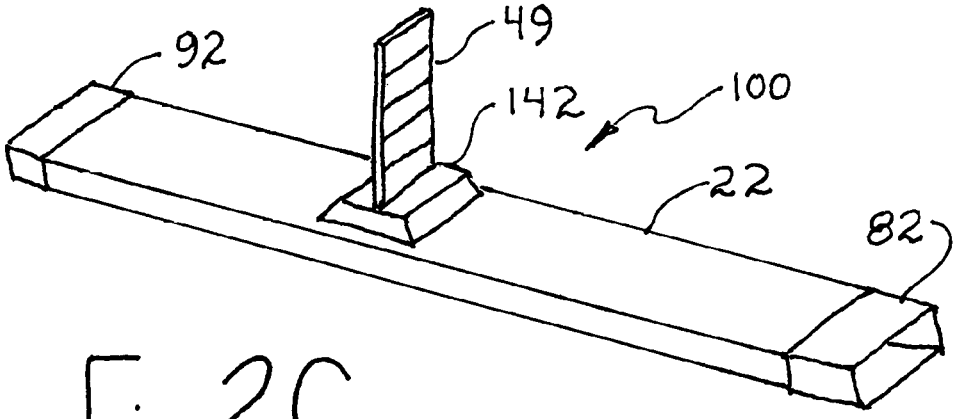
Fig 2C

TRAFFIC CONTROL LIGHT STRIP

CROSS-REFERENCE TO RELATED APPLICATION

This application claims the benefit of and priority under 35 U.S.C. 119(e) of U.S. Provisional Patent Application No. 62/169,729 entitled TRAFFIC CONTROL LED STRIP, filed Jun. 2, 2015 in the name of Damian Stafford, the disclosure of which is incorporated herein by reference.

FIELD OF THE INVENTION

This invention relates generally to traffic warning and control devices and particularly to traffic and warning control devices used in relation to hazard or accident scene management.

BACKGROUND OF THE INVENTION

Since the advent of motor vehicle traffic, a variety of situations have arisen that create the need for redirection and control of vehicle or traffic. In addition to the normal day-to-day traffic control provided by a variety of signal lights and signs, situations often occur that create unforeseen traffic hazards and congestion.

Such events which create unforeseen traffic hazards and congestion vary from serious collisions in which multiple vehicles and personal injury are involved to minor traffic impediments created by stalled or inoperative vehicles blocking one or more traffic lanes. Even the most basic of disabled or abandoned vehicle situations can require substantial traffic flow diversion and management to mitigate the hazards that they present.

For many years, emergency responders and associated traffic control operators have utilized a variety of warning and control devices. Such devices have included road flares, reflective signs, or traffic cones. The basic objective is to diverge or root traffic around such traffic flow impediments or accident scenes. For the most part, reflective traffic cones and reflective signs such as the well-known reflective triangle and hazard warning devices have proven to be cumbersome in use and time consuming in operation. Also, their effectiveness at night in poorly lighted areas leaves a great deal to be desired.

In the face of growing numbers of emergency situations and traffic emergencies and traffic flow impediments, practitioners in the art have endeavored to meet the need for more effective easily deployed traffic warning and control apparatus. For example, U.S. Published Patent Application US 2011/0109235 issued to Link sets forth an EXPANDABLE AND CONTROLLABLE LED LIGHTING STRIP in the form of a transparent long strip having a plurality of LEDs supported upon a flexible printed circuit board in a spaced relationship. The circuit board is coated with a transparent waterproof protective layer and includes a male and female connector at the opposed ends thereof. The connectors facilitate the serial connection of two or more of the lighting strips in an end-to-end relationship. A control chip is packaged on a reverse side of the circuit board for controlling the illumination.

U.S. Pat. No. 6,371,637, issued to Atchison et al, sets forth a COMPACT, FLEXIBLE LED ARRAY that provides a flexible, high density, low profile lighting system that includes a flexible printed circuit board substrate which is adapted to support and electrically interconnect surface mount electronic components. A plurality of surface mount light emitting diodes are mounted on the substrate so as to define a conformable and bendable lighting array configured for mounting upon surfaces with compound curvature. Each of the surface mount light emitting diodes includes a footprint of five square millimeters or less and when mounted adjacent and in contact with one another defines a light density output between 2 and 20 candles per square centimeter.

Published patent application US 2003/0053307 issued to Talamo et al, sets forth a LIGHTING STRIP FOR DIRECTION AND GUIDANCE SYSTEMS that includes an elongated insulating base upon which one or more light emitting diodes strips each supporting a plurality of light emitting diodes are positioned. A terminal housing supporting operative power systems and control apparatus is coupled to one end of the lighting strip while the remaining end may be coupled to an end cap. The light emitting diodes are encapsulated within a light transmission material top cover to provide physical protection and seal for the light emitting diodes.

U.S. Pat. No. 8,168,989 issued to Isobe, sets forth an LED LIGHT SOURCE AND METHOD OF MANUFACTURING THE SAME in which the light emitting diodes of the various colors are mounted upon the frame without dicing the frame for dividing the light emitting diodes into pieces. In this manner the red, green and blue primary color light emitting diode light source may emit a selected color or white.

U.S. Pat. No. 5,848,837, issued to Gustafson, sets forth an INTEGRALLY FORMED LINEAR LIGHT STRIP WITH LIGHT EMITTING DIODES having first and second bus elements spaced apart from one another by a predetermined distance for operative connection to a power source. A substrate strip includes a top surface and a bottom surface having a printed circuit there on. At least one light-emitting diode including electrical contact prongs is provided with the light emitting diode being mounted on the top surface of the substrate strip and with the electrical contact prongs contacting printed circuit on the bottom surface of the substrate strip. An extruded plastic material completely encapsulates the first and second bus element with the substrate strip and the light emitting diodes to provide a protective barrier and make the light strip impervious to moisture.

While the foregoing described prior art devices have to some extent improved the art for traffic control light strips and have, in some instances, enjoyed commercial success, there remains nonetheless a continuing and unresolved need in the art for evermore low cost, efficient and effective apparatus for control of traffic flow and hazard management.

SUMMARY OF THE INVENTION

Accordingly, it is a general object of the present invention to provide an improved traffic control light strip. It is a more particular object of the present invention to provide an improved traffic control light strip which is flexible and supports a plurality of LEDs at spaced intervals. It is a still more particular object of the present invention to provide an improved traffic control light strip that may be serially coupled to other similarly constructed light strips to form an elongated traffic control light strip. It is a still more particular object of the present invention to provide an improved traffic control light strip that supports a power and control unit as a plug-in attachment and further supports a connector plug at each end of the strip.

In accordance with the present invention there is provided a traffic control light strip assembly comprising: first, second and third types of elongated light strip segments each having a generally flat elongated body defining first and second ends, and LED unit supported upon the body.

The traffic control light strip is fabricated by assembling one or more of the first type of light strip segments to a serial assembly of six light strip segments of the second type and thereafter assembling the end of the last second segment to one light strip segment of the third type. The resulting light strip assembly, formed of a serial combination of one first type light strip segment, six second type light strip segments and one third type light strip segment made thereafter be utilized as a single elongated light strip.

The first type of light strip segment includes an elongated body having connectors at both ends and an LED unit there between. A connection pad, preferably near one of the end connectors, is configured to receive and couple to a power and control unit.

The second type light strip segments are identical to each other and include an elongated body having connectors on each end thereof and an LED unit, preferably near the body midpoint.

The third type of light strip segment includes an elongated body having a connector at one end compatible with the second type light strip segment and a connector compatible with another light strip assembly together with an LED unit near the elongated body midpoint.

The resulting traffic control light strip assemblies are capable of being rolled onto a storage and transport reel while remaining serially connected when not in use and extended to and unrolled configuration for deployment upon a roadway surface. Alternatively, the entire traffic control light strip may be fabricated as a single unit rather than a serial combination of light strip segments.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 2B sets forth a perspective assembly view of a traffic control light strip constructed in the accordance with the present invention fabricated as a single elongated unit;

FIG. 2C sets forth a perspective assembly view of a traffic control light strip segment constructed in accordance with the present invention supporting a reflector element;

DESCRIPTION OF THE PREFERRED EMBODIMENTS OF THE INVENTION

Figure 1:
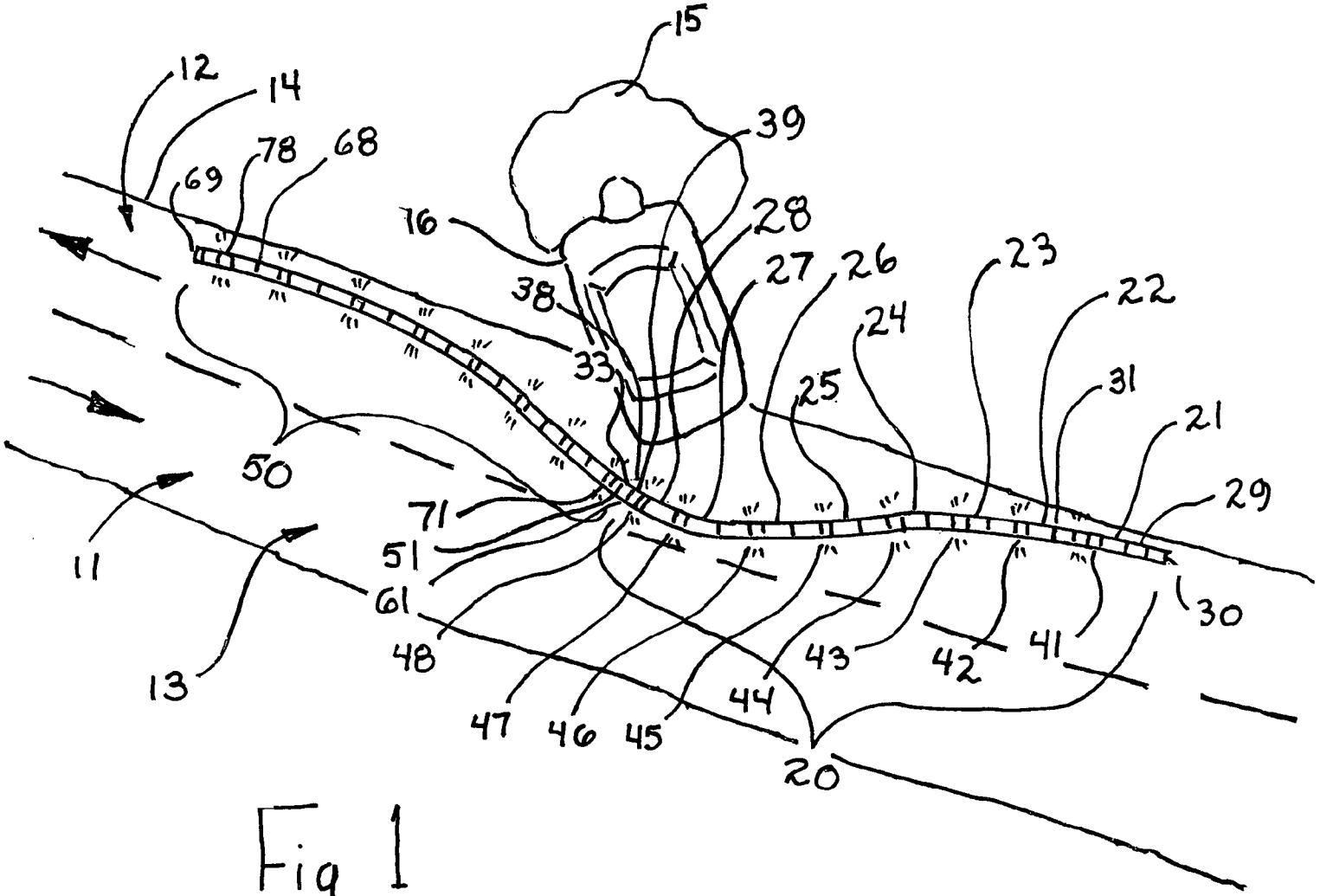
FIG. 1 sets forth a top plan view of an illustrative traffic hazard together with a plurality of traffic control light strips constructed in accordance with the present invention deployed in a protective manner.

FIG. 1 sets forth a top plan view of an illustrative emergency scene, generally referenced by numeral 10, that is an example of a scene toward which the present invention traffic control light strip may be directed. In scene 10, a typical roadway 11 includes opposing lanes 12 and 13. Along one portion of lane 12, a roadway edge 14 is formed defining the outer edge of the payment material for lane 12 of roadway 11. By way of further illustration, a tree 15 is shown adjacent roadway edge 14 and a vehicle 16 is shown having drifted from lane 12 of roadway 11 so as to impact tree 15 and remain partially extending into lane 12 of roadway 11. Thus, in the scene depicted in FIG. 1, an illustration is given in which the collision of vehicle 16 with tree 15 has resulted in disabling vehicle 16 such that the extension of the rear portion of vehicle 16 beyond edge 14 partially obstructs lane 12 of roadway 11. In accordance with the present invention, emergency responders coming upon scene 10 are able to quickly and effectively deploy a pair of serially connected light strip assemblies 20 and 50. The combination of light strip assemblies 20 and 50 provides an elongated lighting strip which, when deployed as shown, will provide a hazard warning for vehicles traveling in the direction indicated by arrow 17 upon lane 12 of roadway 11. Additionally, the deployment of light strip assemblies 20 and 50 is also configured to provide a similar warning for vehicles traveling in the direction indicated by arrow 18 upon lane 13 of roadway 11. In accordance with an important aspect of the present invention, light strip assemblies 20 and 50 are serially connected to provide an overall combined length for the light strip assemblies suited to the accident scene in which they are deployed.

Light strip assemblies 20 and 50 are substantially identical and thus the detailed descriptions which follow for light strip assembly 20 will be understood to apply with equal force and effect to light strip assembly 50. The important aspect with respect to the present invention is the advantage found in the ability of the present invention traffic control light strips to be serially connected and thereby increase the traffic control light strip overall length to meet the needs of a given accident scene. It will also be noted that in the example shown in FIG. 1 light strip assemblies 20 and 50 are each formed of the serial combination of a plurality of light strip segments. It will be further noted that in the particular configuration of the present invention illustrated in FIG. 1 light strip assemblies 20 and 50 utilize a single LED unit for each light strip segment. While this arrangement has been found to be advantageous, it will be apparent to those skilled in the art that alternative numbers of LED units may be employed for each light strip segment without departing from the spirit and scope of the present invention. It will be equally apparent that while the utilization of eight light strip segments has been employed in fabricating light strip assemblies 20 and 50, this number is provided primarily for purposes of illustration. It will be equally apparent to those skilled in the art that a different number of light strip segments may be serially joined to form a light strip assembly without departing from the spirit and scope of the present invention.

With particular reference to light strip assembly 20, a plurality of light strip segments 21 through 28 are serially joined by a corresponding plurality of cooperating connector pairs 31 through 37. The structure of connector pairs 31 through 37 is set forth below in greater detail. Suffice it to note here that connector pairs 31 through 37 provide mechanical attachment between adjacent light strip segments together with appropriate electrical connections therebetween. Connectors 30 and 38 facilitate connection of light strip assembly 20 to other light strip assemblies in a manner that allows the action of the LED units to be synchronized. Each of light strip segments 21 through 28 supports an LED unit 41 through 48 respectively. For purposes of the example shown herein, each LED unit will be understood to support a single high power light emitting diode. Once again, it will be apparent to those skilled in the art that a variety of light emitting diode configurations may be utilized within LED units 41 through 48 without departing from the spirit and scope of the present invention. For example, each LED unit may support a light emitting diode which emits light of a selected color, white light or infrared light to suit particular needs. By way of further alternative, pluralities of light emitting diodes, having different color, or brightness outputs, may be supported within each of the LED units to provide alternative color effects.

In the preferred fabrication of the present invention, light strip assembly 20 utilizes light strip segments 21 through 28 with each segment being approximately three feet in length. In further accordance with the preferred fabrication of the present invention traffic control light strip, eight three foot segments are combined to provide an overall length of approximately twenty-four feet for light strip assembly 20. Once again, it will be understood that, while this arrangement has been found to be advantageous, the present invention is not limited to any particular light strip segment length or number of light strip segments joined to form the inventive light strip assembly.

As mentioned above, light strip assembly 50 will be understood to be substantially identical to light strip assembly 20. In accordance with an important aspect of the present invention light strip assembly 20 includes a connector 38 while light strip assembly 50 includes a cooperating connector 61. Accordingly, the serial combination of light strip assembly 20 and light strip assembly 50 is accomplished by the connection provided by cooperating connectors 38 and 61.

A power and control unit 29 is attached to one end of light strip assembly 20 in the manner set forth below in greater detail. Suffice it to note here that the attachment of power and control unit 29 to the end of light strip assembly 20 provides electrical connection between the operative circuitry within power and control unit 29 and the electrical circuit within light strip segments 21 through 28. It will be recalled that connector pairs 31 through 37 provide electrical connections between their respective light strip segments. Similarly the connection provided by connectors 38 and 61 further couples control circuit 29 to control circuit 39 of light strip assembly 50. In this manner, a single control unit is able to control all of the light emitting diodes within light strip assemblies 20 and 50.

Once light strip assemblies 20 and 50 have been deployed and joined serially in the manner shown in FIG. 1, an effective warning barrier of high intensity lights is provided to signal the hazard presented by vehicle 16 to vehicles traveling in both directions 17 and 18. The resulting warning light barrier is easily and quickly deployed in the manner set forth below to provide for quick and effective control of traffic moving upon roadway 11. Once the emergency situation has been resolved and vehicle 16 has been removed, power and control units 29 and 39 are deactivated and, thereafter, light strip assemblies 20 and 50 are disconnected by separating connectors 61 and 38. Light strip assemblies 20 and 50 may then the rolled onto a storage reel shown in FIG. 7 and stored in the manner also shown in FIG. 7. The structure of the storage reel is set forth below in FIG. 7 in greater detail. Suffice it to note here that the storage reel may include a handle porting a remote control as well as one or more storage receptacles for receiving additional battery pack units.

Figure 2A:
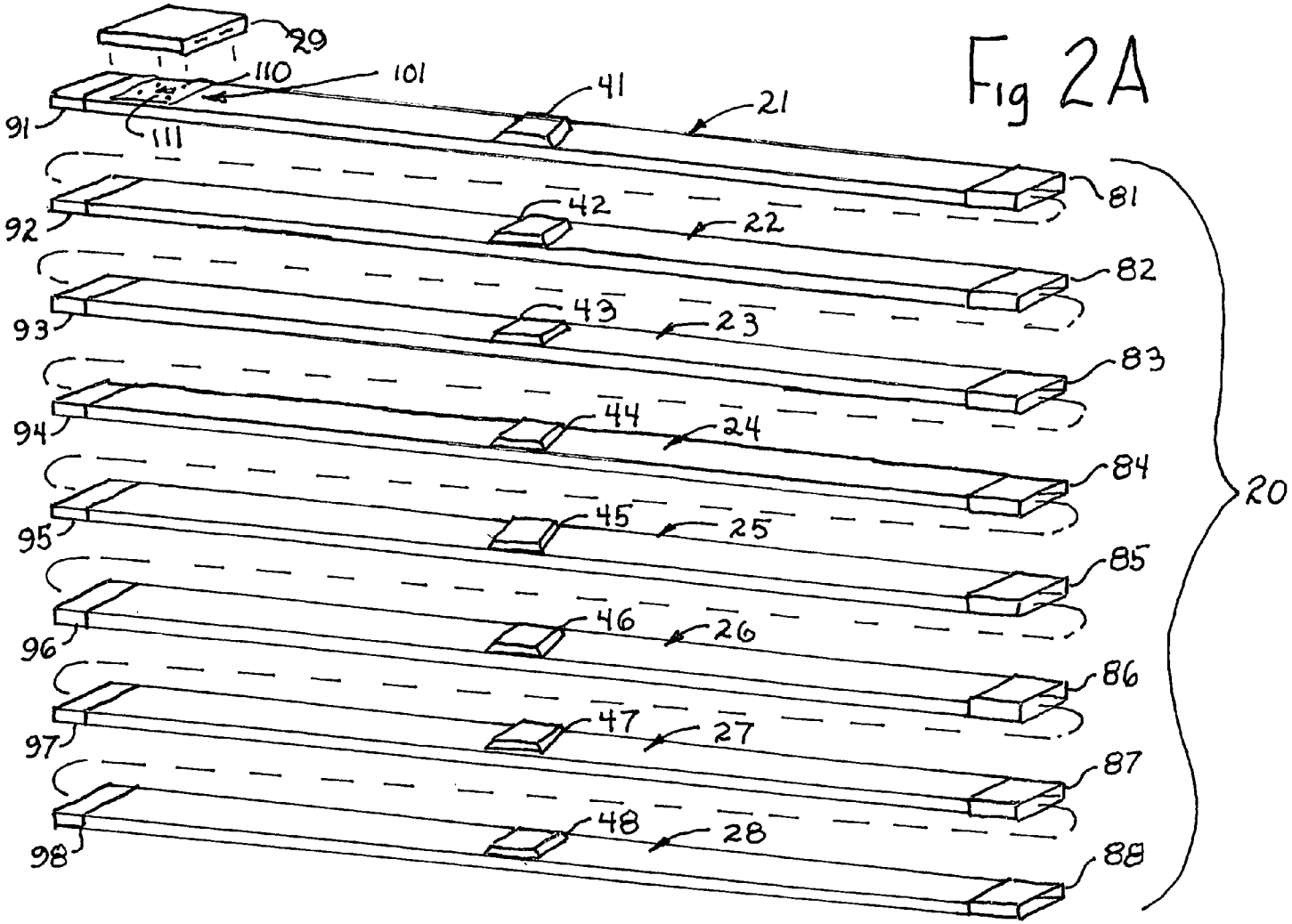
FIG. 2A sets forth a perspective assembly view of a traffic control light strip constructed in accordance with the present invention.

FIG. 2A sets forth a perspective assembly view of light strip assembly 20. As mentioned above, light strip assembly 20 is fabricated by joining eight light strip segments utilizing a plurality of cooperating connector pairs 31 through 37 (seen in FIG. 1). As is also mentioned above, light strip assembly 20 supports a cooperating power and control unit 29 which is able to power and control the light producing apparatus within light strip assembly 20.

By way of overview, and as is mentioned, above, light strip assembly 20 includes light strip segments fabricated as three basic segment types. Light strip segments (such as segment 21) of the first segment type support an LED unit and are constructed to provide one connector able to make a synchronizing signal and mechanical connection to another light strip assembly together with a second connector for power and control connection to another light strip segment. The second type of light strip segments (segments 22 through 27) support an LED unit together with connectors at each end suitable for power and control coupling to another light strip segment. The third type of light strip segment (segment 28) supports an LED unit and one connector at one and for power and control connection to another light strip segment and one connector at the remaining end configured to make a control signal connection and mechanical attachment to another light strip assembly.

More specifically, light strip segment 21 (which is configured as a first type) includes a connector plug 91 at one end thereof and a connector receptacle 81 at its opposite end. Light strip segment 21 further supports an LED unit 41. For purposes of illustration, LED unit 41 is shown near the midpoint of light strip segment 21. However it will be apparent to those skilled in the art that the position of LED unit 41 is a matter of design choice and the centered position of LED unit 41 shown in FIG. 2 is merely illustrative and should not be interpreted as a limitation of the present invention. Light strip segment 21 further includes a connection pad 101 near connector plug 91. Connection pad 101 is configured to receive and facilitate attachment of a power and control unit 29. Accordingly, connection pad 101 includes a plurality of sockets 110 together with a plurality of exposed electrical contacts 111. The structure of connection pad 101 is also set forth below in FIG. 5 in greater detail. However, suffice it to note here that contacts 111 facilitate electrical connection between LED unit 41 and power and control unit 29.

Light strip segments 22 through 27 are light strip segments of the second type and are substantially identical to each other. Accordingly, light strip segment 22 supports an LED unit 42 together with a connector plug 92 and a connector receptacle 82 at opposed ends thereof. Similarly, light strip segments 23 through 27 support respective LED units 43 through 47 together with respective connector plugs 93 through 97 and respective connector receptacles 83 through 87. Lights strip segment 28 is a segment of the third type having a connector 98 suitable for power and control coupling to another strip segments such as segment 27 and a connector 88 suitable for providing control signal coupling to another light strip assembly.

The fabrication of light strip assembly 20 is carried forward by connecting light strip segments 21 through 28 in a serial fashion. This assembly is carried forward by inserting connector plugs 92 through 98 into connector receptacles 81 through 87 respectively. As mentioned above, and as is set forth below, the insertion of a connector plug into a connector receptacle provides both mechanical attachment and electrical connection. Thus, as connector plug 92 is inserted into connector receptacle 81, light strip segments 21 and 22 are joined mechanically and electrical connection is provided between the conductors (seen below) within light strip segment 21 and those of light strip segment 22. Similarly, insertion of connector plug 93 into connector receptacle 82 performs a similar mechanical and electrical connection. In the same manner, insertion of connector plugs 94 through 98 into connector receptacles 83 through 87 performs a similar mechanical and electrical connection to complete light strip assembly 20.

In the preferred fabrication of light strip assembly 20, the mechanical connection provided between connector plugs 92 through 98 within connector receptacles 81 through 87 respectively is enhanced by additional attachment operations such as thermal or sonic welding. It will be apparent that other forms of additional attachment may be utilized such as engaging spring clips or threaded fasteners. For purposes of improved safety, the attachment between connector plugs 92 through 98 and connector receptacles 81 through 87 is configured to provide a "breakaway" attachment characterized by separation of the connector plug from its respective connector receptacle when subjected to an excessive force. It has been determined that the attachment of each connector plug to its cooperating connector receptacle should separate when subjected to a stress exceeding a one hundred pound force. This breakaway characteristic is desirable to provide an enhanced safety factor in the unlikely event that a deployed traffic control light strip constructed in accordance with the present invention becomes entangled with a passing vehicle or other similar occurrence.

Connector plugs and connector receptacles used in light strip assembly 20 are fabricated of a molded plastic material which readily facilitates the breakaway characteristic. As a result, the desired separation characteristic is readily provided by controlling the thickness of material utilized in forming each of the connector receptacles and controlling the extent and number of attachment welds utilized in fabricating light strip assembly 20.

FIG. 2B sets forth a perspective view of an alternate embodiment of the present invention traffic control light strip assembly generally referenced by numeral 60. Light strip assembly 30 differs from light strip assembly 20 set forth above in that it is fabricated of a single elongated flexible body rather than a plurality of strip segments joined by connectors. Thus light strip assembly 60 includes an elongated flexible body 70 having a connector 91 at one end and a connector receptacle 88 at the remaining end. Body 70 further supports a plurality of LED units 41 through 48. Body 70 further supports a connection pad 101 which is substantially identical to connection pad 101 shown in FIG. 2A above. In further similarity to FIG. 2A above, a power and control unit 29 is received upon connection pad 101. The operation of light strip assembly 60 is substantially identical to the operation of light strip assembly 20 described above. Specifically power and control unit 29 provides electrical power for operating and controlling LED units 41 through 48. By way of further similarity connector plug 91 is configured to provide controls signal coupling and mechanical attachment to an additional light strip assembly. Also connector receptacle 88 is configured to receive the connector plug of another light strip assembly and provide mechanical attachment there between and control signal coupling.

FIG. 2C sets forth a perspective view of a still further alternate embodiment of the present invention traffic control light strip showing a light strip segment generally referenced by numeral 100 which differs from other light strip segments (such as light strip segments 22 through 27 set forth above in FIG. 2A) in that an LED unit 142 supports a "flip-up" reflector 49. The structure of LED unit 142 is, apart from the attachment of reflector 49, substantially the same as LED unit 42, set forth below in FIG. 7 in greater detail. Suffice it to note here that reflector 49 is preferably formed of a flexible material and thus is able to bend when strip segment 100 is rolled for storage in the manner set forth below in FIG. 6

Figure 3A:
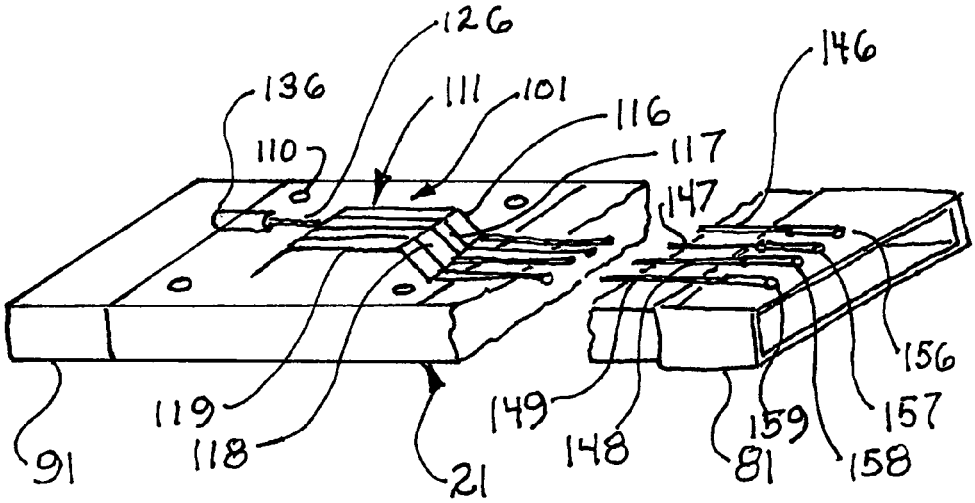
FIG. 3A sets forth a partial perspective view of the flexible base of the present invention traffic control light strip constructed to be the initial segment of the light strip assembly and constructed to receive a power and control unit.

FIG. 3A sets forth a perspective view of light strip segment 21. As described above, light strip segment 21 defines an elongated generally flat body having a connector plug 91 at one end thereof and a connector receptacle 81 at the remaining end thereof. Connector plug 91 supports a single female connector 136 while connector receptacle 81 supports a plurality of connector pins 156, 157, 158, and 159. Light strip segment 21 further defines a connection pad 101 having contacts 111 supported thereon. Contacts 111 include a plurality of spring contacts 116, 117, 118 and 119. A connecting wire 126 provides control connection between female connector 136 and spring contact 116 to synchronize illumination patterns between light strip assemblies. A further plurality of connecting wires 146, 147, 148 and 149 provide electrical connection between spring contacts 116 through 119 and connector pins 156 through 159. Thus, it will be noted that connecting wires extending between contacts 111 and connector receptacle 81 produce electrical connection passing through light strip segment 21. This is the manner in which serial connection between light strip segments is provided. As is better seen in FIG. 5, connecting wires 146 through 149 also provide electrical connection to LED unit 41. Returning to FIG. 3A, it will be noted that spring contact 116 is electrically connected to female connector 136. By means set forth below in greater detail, spring connectors 116 through 119 provide electrical connection to light strip segment 21 when power and control unit 29 is attached to the light strip. Suffice it to note here that attachment of power and control unit 29 applies appropriate electrical power and operative electrical signals to light strip segment 21 through spring contacts 116 through 119.

Figure 3B:
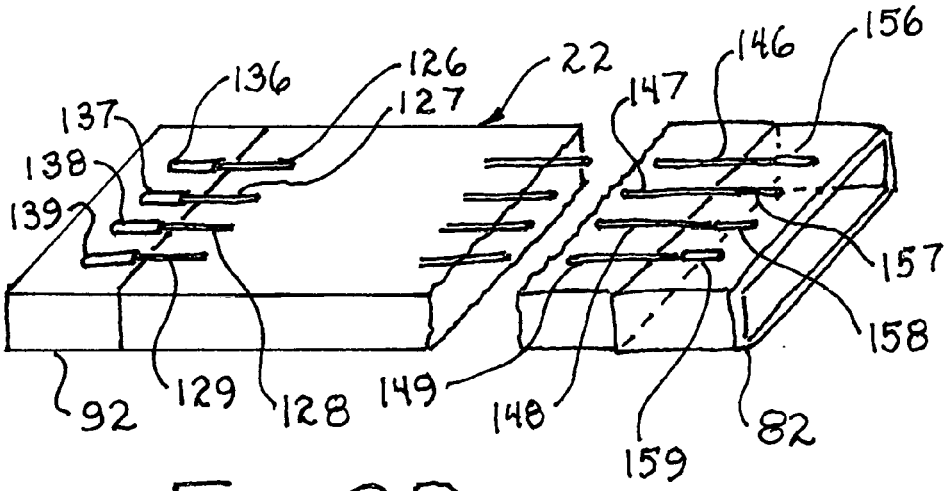
FIG. 3B sets forth a perspective assembly view of the flexible base of the present invention traffic control light strip constructed to be an intermediate strip segment.

FIG. 3B sets forth a perspective view of light strip segment 22. As described above, light strip segment 22 defines an elongated generally flat body having a connector plug 92 at one end thereof and a connector receptacle 82 at the remaining end thereof. Connector plug 92 supports a plurality of connectors 136, 137, 138 and 139 while connector receptacle 82 supports a plurality of connector pins 156, 157, 158, and 159. Light strip segment 22 further supports an LED unit 42 (seen in FIG. 2A). Receptacle 81 supports a plurality of connector pins 156, 157, 158, and 159.

Figure 3C:
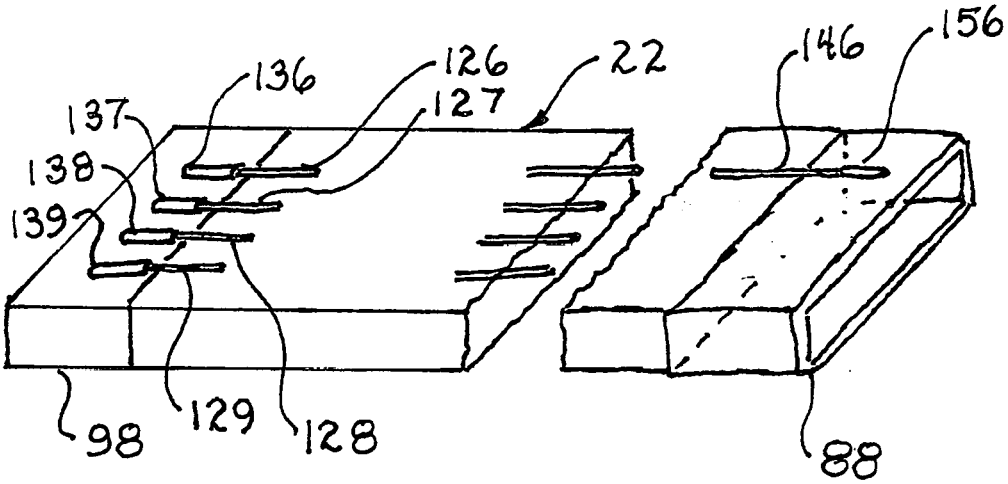
FIG. 3C sets forth a perspective assembly view of the flexible base of the present invention traffic control light strip constructed to be an end strip segment.

FIG. 3C sets forth a perspective view of light strip segment 28. As described above, light strip segment 28 defines an elongated generally flat body having a connector plug 98 at one end thereof and a connector receptacle 88 at the remaining end thereof. Connector plug 98 supports a plurality of connectors 136, 137, 138 and 139 while connector receptacle 88 supports a single connector pin 156. Light strip segment 28 further supports an LED unit 48 (seen in FIG. 2A). Receptacle 88 supports a single connector pin 156.

Figure 4:
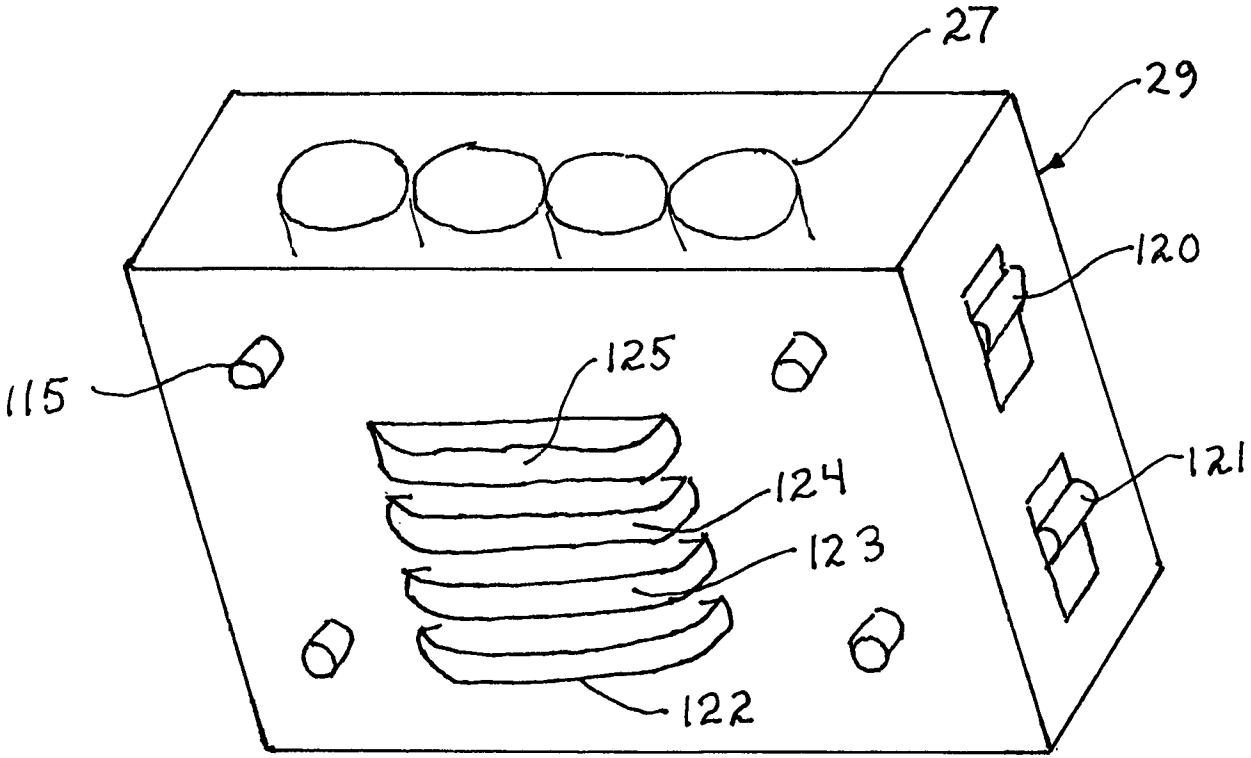
FIG. 4 sets forth a bottom perspective view of the power and control unit of the present invention traffic control light strip.

FIG. 4 sets forth a bottom perspective view of power and control unit 29. As mentioned above, power and control unit 29 is attached to connection pad (seen in FIG. 5) to provide electrical operating power and control to the light emitting diodes within the LED units such as LED unit 41 supported upon light strip segment 21 (seen in FIG. 2A). Power and control unit 29 includes a plurality of batteries 27 constructed in accordance with conventional fabrication techniques which are used to provide operating power for the light strip segments within the present invention light strip assembly. The operation of the power and control circuitry within power and control unit 29 is described below in FIG. 8. Suffice it to note here that conventional electrical wiring (not shown) is utilized within power and control unit 29 to couple batteries 27 to the operative circuitry within power and control unit 29. A power switch 120 and a mode select switch 121 are supported upon power and control unit 29 and are utilized in activating and de-activating the power control unit as well as selecting the particular LED flashing pattern desired by be user when the traffic and control strip is deployed. As is also set forth in FIG. 8, a remote control may be employed. The bottom surface of power and control unit 29 reports a plurality of downwardly extending generally cylindrical attachment posts 115 together with a plurality of contacts 112. Contacts 112 include a plurality of downwardly extending spring contacts 122 through 125. With concurrent reference to FIGS. 3A and 5, the assembly of power and control unit 29 to connection pad 101 of light strip 21 is carried forward by positioning power and control unit 29 above connection pad 101 so as to align posts 115 with sockets 110. Thereafter, power and control unit 29 is lowered onto connection pad 101 inserting posts 115 into sockets 110. In the preferred fabrication of the present invention the relative size of posts 115 and sockets 110 is selected to provide a "moderately tight fit". In this manner the attachment between power and control unit 29 and connection pad 101 is sufficient to maintain the position of power and control unit 29 upon connection pad 101. Spring contacts 122 through 125 are positioned upon the bottom surface of power and control unit 29 to provide alignment between spring contacts 122 through 125 and spring contacts 116 through 119 thereby establishing electrical signal and power coupling between power and control unit 29 and light strip segment 21.

Returning to FIG. 4, once power and control unit 29 is secured to light strip segment 21 in the manner described above, power switch 120 provides an "on/off" functional control to activate or deactivate the light strip. Similarly, mode select switch 121 is used to set the operating mode by which power and control unit 29 causes the illumination pattern of light emitting diodes within the light strip assembly to be established. As mentioned above in the preferred fabrication of the present invention power and control unit 29 is selectively operated in illumination patterns which vary and which, may for example, include steady illumination of all LED units, flashing illumination of some or all LED units, sequential illumination of LED units or alternating illumination of LED units. Once again, it will be noted that power and control unit 29 may be remotely controlled.

Figure 5:
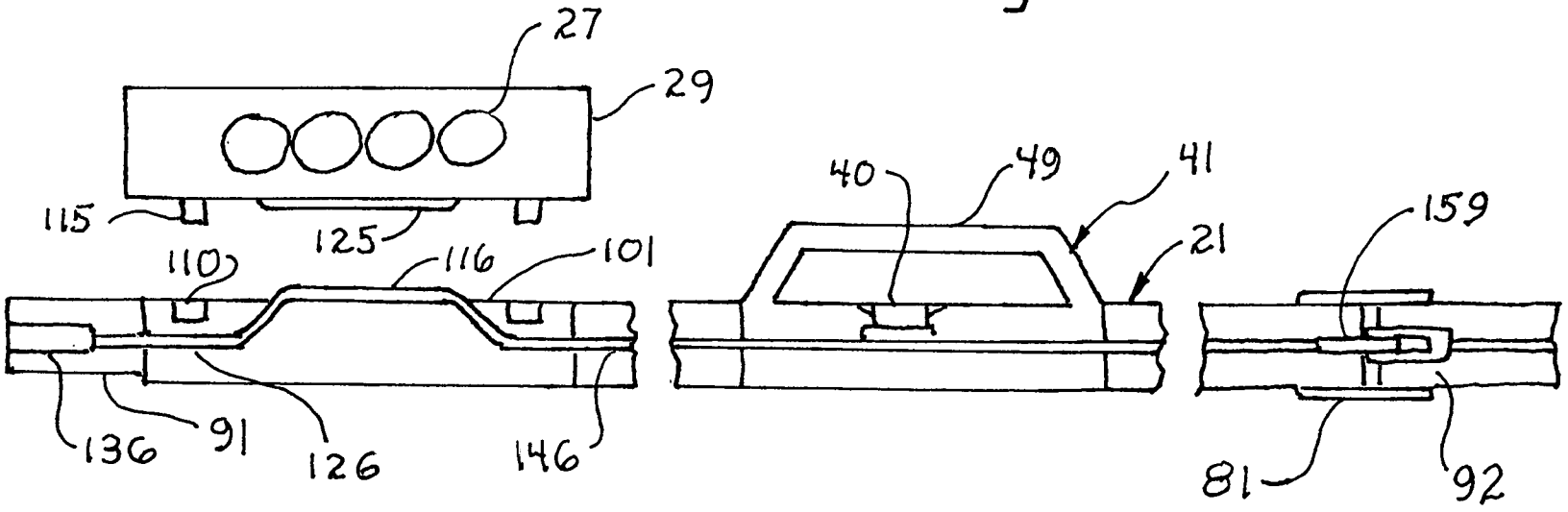
FIG. 5 sets forth a section view of the initial strip segment of present invention traffic control light strip.

FIG. 5 sets forth a partial section view of light strip segment 21 together with power and control unit 29. Light strip segment 21 forms an elongated generally flat body having a connector plug 91 supported at one end and a connector receptacle 81 supported at the opposite end. Light strip segment 21 further includes a connection pad 101 having a plurality of sockets 110 and a plurality of electrical contacts 111. As is seen in FIG. 3A, contacts 111 include a plurality of spring contacts such as contact 119. Power and control unit 29 supports a plurality of batteries 27 together with operational and control circuitry (seen in FIG. 8). Power and control unit 29 also includes a plurality of downwardly extending posts 115 which are received within sockets 110 as power and control unit 29 is assembled to connection pad 101 of light strip segment 21. The attachment of power and control unit 29 to connection pad 101 produces electrical connection between spring contacts 122 through 125 of power and control unit 29 (seen in FIG. 4) and contacts 116 through 119 of connection pad 101 (seen in FIG. 3A).

Connector plug 91 supports a female connector 136 while connecting wire 126 provides electrical connection between female connector 136 and contact 116. Connector receptacle 81 supports a connector pin 159 which is coupled to contact 119 by a connecting wire 149. A connector plug 92 is shown inserted into connector receptacle 81 for purposes of illustration. Light strip segment 21 includes an LED unit 41. LED unit 41 is formed of a high strength material such as high strength plastic or the like which is either transparent, color tinted or light transmissive frosted material. LED unit 41 includes a dome 49 which protects light emitting diode 40 supported within LED unit 41 in the event that a vehicle runs over LED unit 41. In addition, dome 49 transmits light energy emanating from light emitting diode 40. Connecting wire 146 provides electrical connection to light emitting diode 40.

Figure 6:
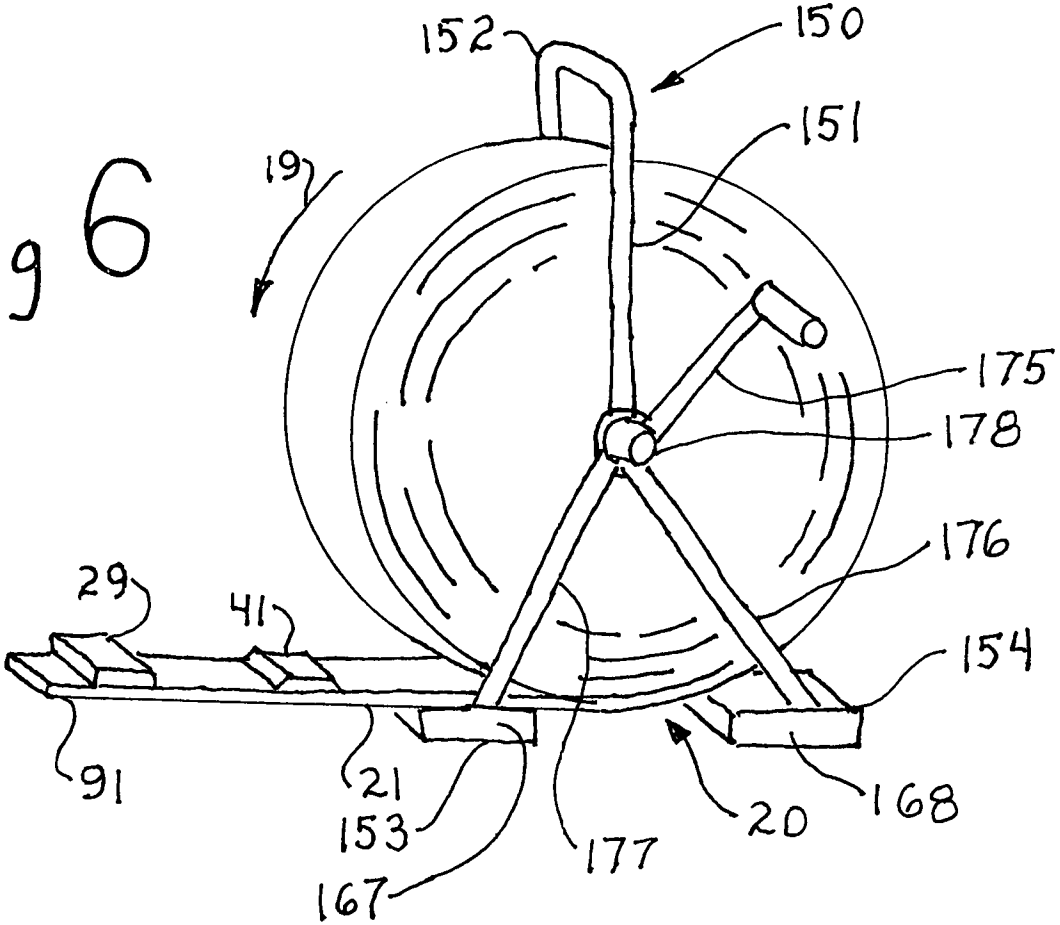
FIG. 6 sets forth a perspective view of the present invention traffic control light strip supported upon a storage reel.

FIG. 6 sets forth a perspective view of light strip assembly 20 being configured to or from a transport or storage configuration. In accordance with an important aspect of the present invention the flexible material from which light strip assembly 20 is fabricated facilitates the convenient rolling of light strip assembly 20 upon a storage reel 150 in the direction indicated by arrow 19. Once light strip assembly 20 has been fully rolled upon storage reel 150, it may be conveniently stored. Storage reel 150 is of substantially conventional construction and includes a center hub 178 supported by a pair of base members 176 and 177. Base members 176 and 177 are supported by bases 154 and 153 respectively. A handle 152 is supported above hub and 178 by a U-shaped vertical support 151. Bases 153 and 154 each include respective battery storage departments 167 and 168. Storage compartments 167 and 168 function to provide convenient storage of backup battery units for powering the traffic control strip during extended use. Handle 152 supports a remote control 170 (seen in FIG. 8).

Figure 7:
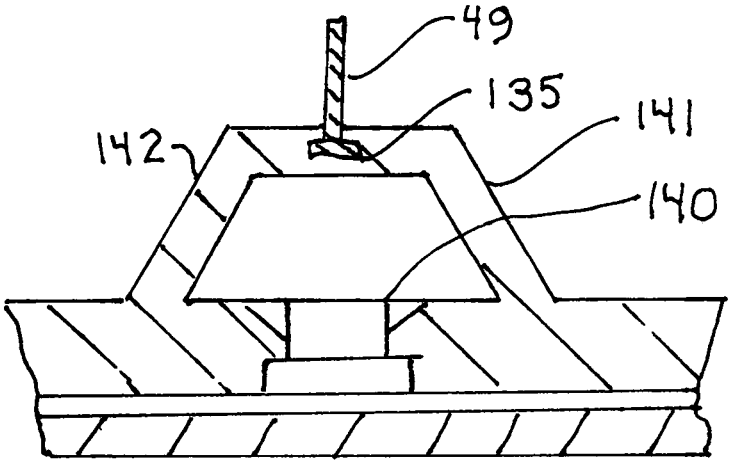
FIG. 7 sets forth a section view of an alternate LED unit of the present invention traffic control light strip supporting a flip-up reflector.

FIG. 7 sets forth a section view of an LED unit 142 which supports a flip up collector 49 in the manner set forth above in FIG. 2C. As described above LED unit 142 is substantially identical to LED unit 42 described above with the difference being found in the attachment of flip up reflector 49. Accordingly LED unit 142 includes an internally supported LED 140 housed within a light transmission dome 141. Dome 141 further includes a channel 135 which receives the lower end of reflector 49. The attachment of the lower and of reflector 49 within channel 135 is accomplished by simply sliding the headed portion of the lower end of reflector 49 into channel 135.

Figure 8:
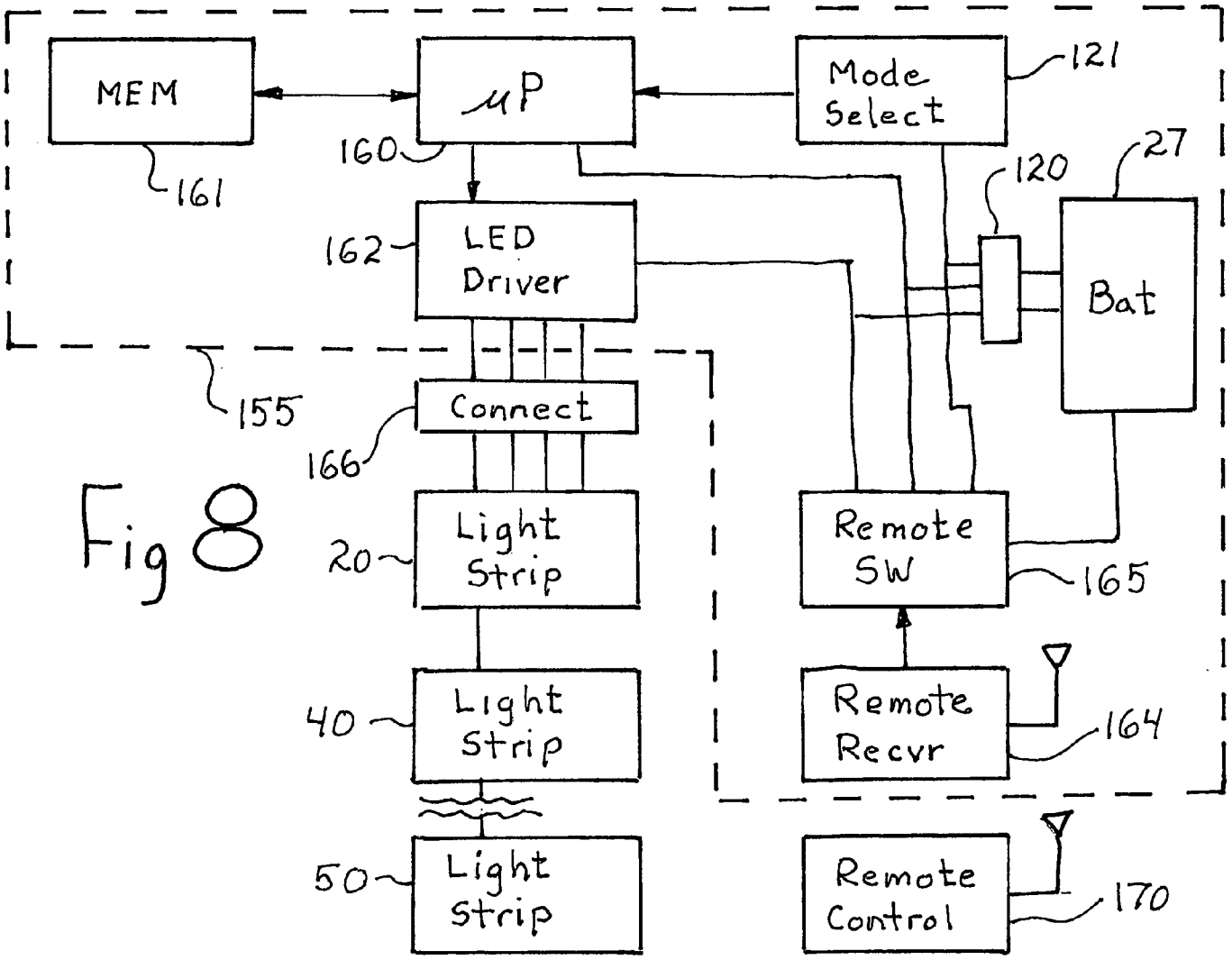
FIG. 8 sets forth a block diagram of the power and control unit of the present invention traffic control light strip.

FIG. 8 sets forth an operational block diagram of a power and control system 155 operative within power and control unit 29 (seen in FIG. 2A). Also shown in FIG. 8 is a plurality of light strip assemblies 20, 40 and 50 serially joined to form a light strip array controlled by power and control unit 29. A microprocessor 160 includes an associated processor memory 161 coupled thereto. An LED driver 162 is operatively coupled to microprocessor 160 and is further coupled to a multiple connection connector array 166. A mode selection circuit 121 is operatively coupled to microprocessor 160. A battery power supply 27 includes a plurality of conventional batteries. Battery supply 27 is further coupled to a power switch 120 through which battery power is coupled to microprocessor 160, LED driver 162 and mode selection circuit 121. Power switch 120 provides an "on/off" function for conserving battery power during periods of storage and non-operation. Battery power supply 27 may utilize conventional replaceable batteries. Power and control system 155 further includes a remote signal receiver 164 coupled to a remote system switch 165. A remote control handheld unit 170 is utilized in combination with remote signal receiver 164. The combination of remote signal receiver 164 and handheld unit provides the user with the capability to operate and configure power and control system 155 from a remote location. Remote handheld unit 170 and remote signal receiver 164 may utilize virtually any conventional wireless communication protocol without departing from the spirit and scope of the present invention.

In operation, switch 120 is moved to the "on position" which activates the system components within power and control system 155. Mode select circuit 121 provides mode selection information to microprocessor 160. In response to the mode selection input, microprocessor 160 accesses memory 161. Within memory 161 a software program that is utilized in the operation of microprocessor 160 is stored. Accordingly, in response to the mode selection input and the stored operating program within memory 161, microprocessor 160 configures LED driver 162 to provide operating electrical signals to connector array 166. Light strip assemblies 20, 40 and 50 respond to the applied control and power signals to produce the desired illumination pattern within the light strip assemblies.

As mentioned above, power and control system 155 may be operated remotely utilizing the communication between handheld remote control unit 170 and remote receiver 164. Thus, the user is able to actuate handheld remote control unit 172 to communicate changes in the operation of power and control system 155. The extent of remote operation is determined by the fabrication of the remote control system. In the configuration shown in FIG. 8, remote operation is able to communicate signals to power and control system 155 capable of activating and deactivating the system and altering or selecting the illumination mode applied to light strip assemblies 20, 40 and 50. The extent and degree of remote control provided is a matter of design choice.

Figure 9:
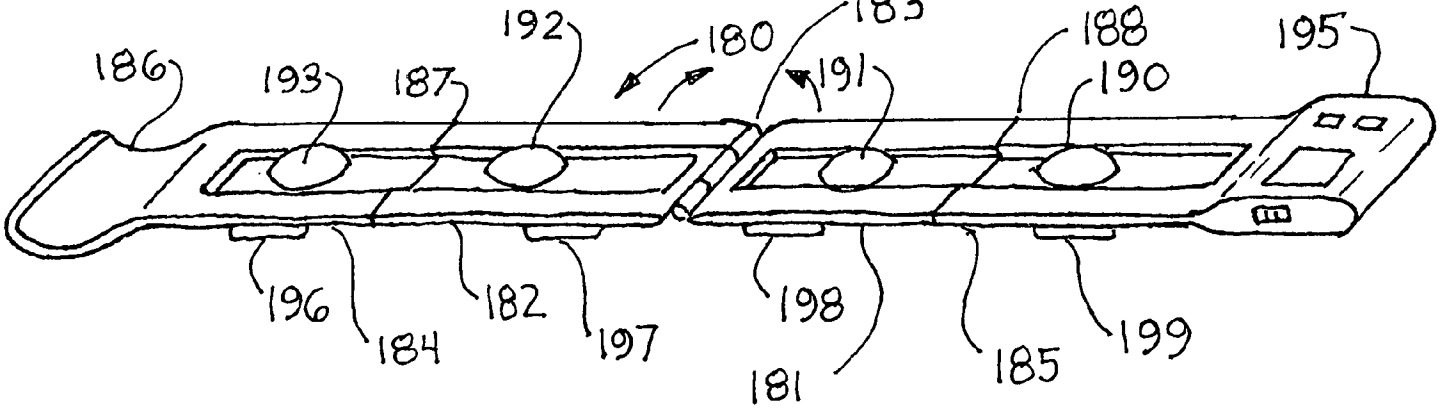
FIG. 9 sets forth a perspective view of an alternate embodiment of the present invention traffic control light strip in an open configuration.
Figure 10:
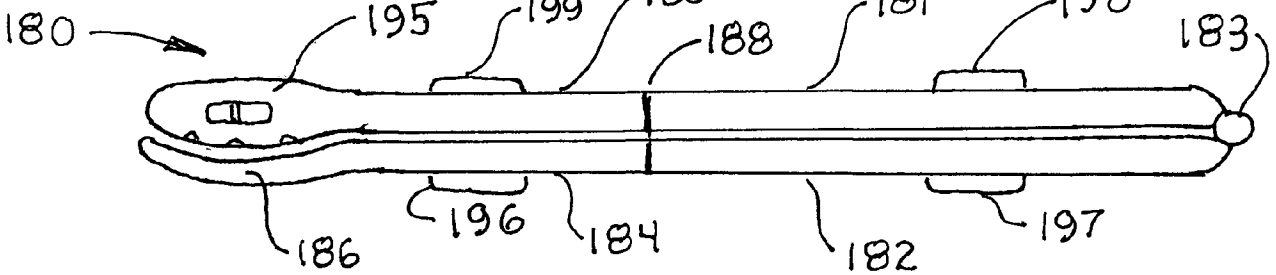
FIG. 10 sets forth a side elevation view of the alternate embodiment of the present invention traffic control light strip shown in FIG. 9 folded into a closed configuration.

FIG. 9 sets forth a perspective view of an alternate embodiment of the present invention traffic control light strip generally referenced by numeral 180. Traffic control light strip 180 is a "folding" embodiment of the present invention. Accordingly, traffic control light strip 180 includes a pair of light strip segments 181 and 182 joined by a hinge 183 two provide a traffic control light strip which may be unfolded to the open configuration shown in FIG. 9 during use and which may be folded to the closed configuration set forth in FIG. 10. In addition, each of light strip segments 181 and 182 further include telescoping extendable portions 184 and 185 respectively. This extension capability facilitates a maximum length for the traffic control light strip in its fully unfolded and extended configuration, as seen in FIG. 9 while also providing an extremely compact folded configuration, as seen in FIG. 10.

More particularly, traffic control light strip 180 includes a pair of light strip segments 181 and 182 pivotally joined by a hinge 183. Light strip segment includes an extendable member 185 which is joined to light strip segment 181 by a telescoping junction 188. Junction 188 facilitates the extension of extendable member 185 away from light strip segment 181 for a distance of approximately twelve inches. Conversely, extension junction 188 allows extendable member 185 to be moved into light strip segment 181 to a compact configuration in which the overall length is decreased by twelve inches. Similarly, junction 187 facilitates the extension of extendable member 184 away from light strip segment 182 for a distance of approximately twelve inches. Conversely, extension joined 187 allows extendable member 184 to be moved into light strip segment 182 to a compact configuration in which the overall length is decreased by twelve inches.

Light strip segment 181 supports a light transmissive dome 191 while extendable member 185 reports a light transmissive dome 190. Similarly, light strip segment 182 supports a light transmissive dome 192 while extendable member 184 supports a light transmissive dome 193. Each of domes 190, 191, 192 and 193 supports one or more light emitting diodes which provide illumination of each of the light transmissive domes. Extendable member 185 further supports a power and control unit 200. Extendable member 184 further supports a protective lip 186. In accordance with the above-described operation, power and control unit 200 includes a battery power supply together with a microprocessor control circuit which energizes each of the light emitting diodes within domes 190, 191, 192 and 193 to produce the desired illumination pattern selected by the user. Power and control unit 200 further supports an LED work light 195. Traffic control light strip 180 is configured from the open configuration shown in FIG. 9 to the closed configuration shown in FIG. 10 by initially moving extendable members 184 and 185 into light strip segments 182 and 181 respectively and thereafter folding light strip segments 181 and 182 together. Segments 181, 182, 184 and 185 each support a magnet 196, 197, 198 and 199 respectively which facilitate attachment of traffic control light strip 180 to a metal surface such as a vehicle surface or the like.

Figure 11:
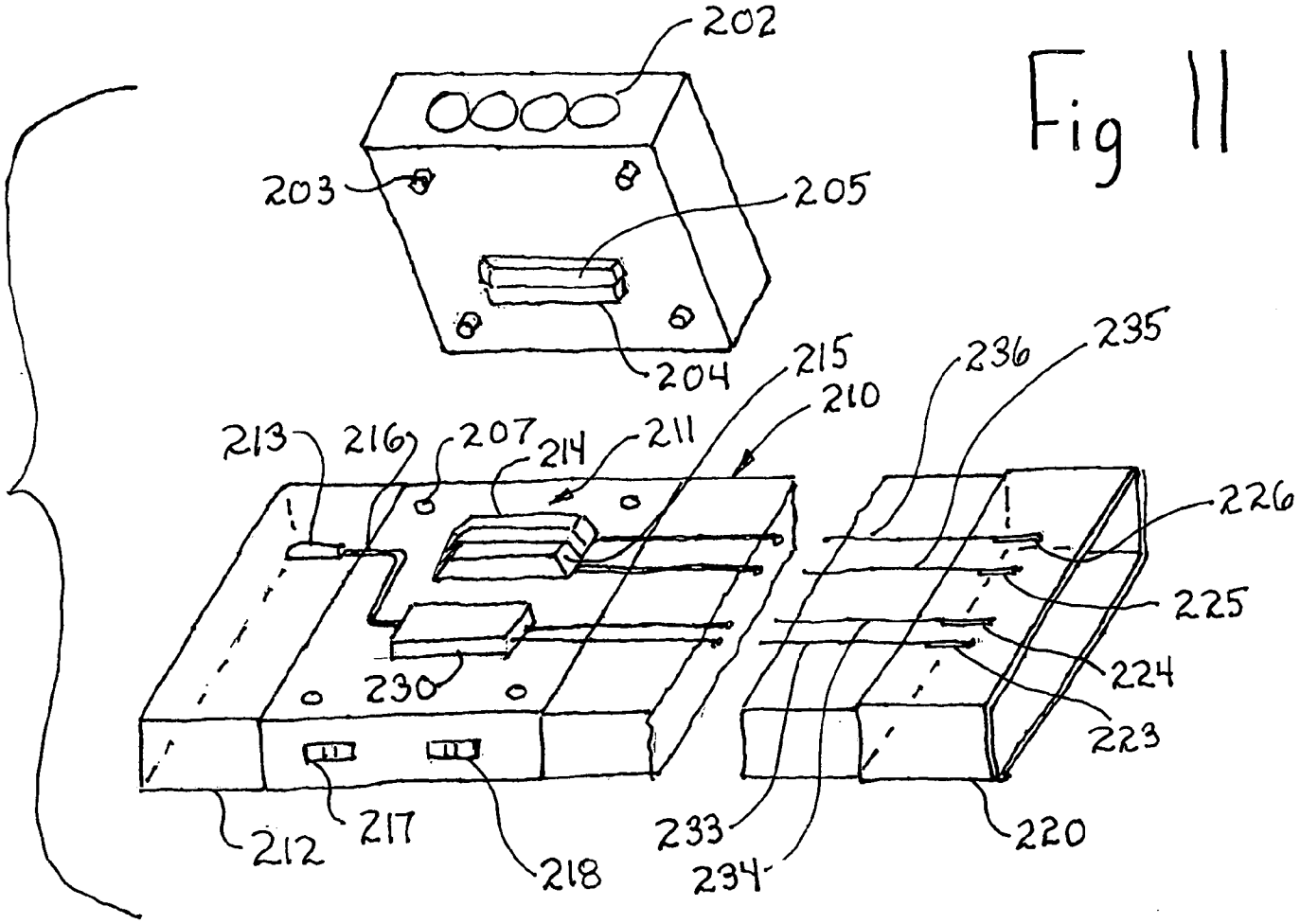
FIG. 11 sets forth a perspective view of a still further alternate embodiment of the present invention traffic control light strip.

FIG. 11 sets forth a perspective assembly view of a still further alternate embodiment of the present invention traffic control light strip. Specifically, the alternate embodiment shown in FIG. 11 provides an alternative light strip segment generally referenced by numeral 210 which provides an alternate initial strip segment to be utilized in place of light strip segment 21 set forth above in FIG. 3A. By way of overview, and with concurrent reference to FIGS. 11 and 3A, it will be understood that light strip segment 210 differs from light strip segment 21 in that a control circuit 230, constructed in accordance with the control circuit of FIG. 8, is supported within light strip segment 210 rather than being supported within the cooperating power unit as is set forth above. Accordingly, it will be further understood that power unit 201 differs from power and control unit 29 (seen in FIG. 4) in that power unit 201 supports a plurality of batteries 202 but does not support control circuit 230.

More specifically, light strip segment 210 includes an elongated generally flat body supporting a plug connector 212 at one end and a connector receptacle 220 at the remaining end. Light strip segment 210 further supports a power and control circuit 230 which is constructed in accordance with the operational circuit set forth in FIG. 8. Light strip segment 210 further includes a female connector 213 supported within plug connector 212. Female connector 213 is coupled to control circuit 230 by a connecting wire 216. Light strip segment 210 further supports a connection pad 211 which includes four sockets 207 and a contact assembly 228. A pair of spring connectors 214 and 215 are supported within contact assembly 228. Connector receptacle 220 supports a plurality of connector pins 223, 224, 225 and 226 which are coupled to control circuit 230 and spring contacts 214 and 215 by a plurality of connecting wires 233, 234, 235 and 236 respectively. An on/off switch 217 and a mode select switch 218 are supported upon light strip segment 210 and by conventional wiring are coupled to control circuit 230.

A power unit 201 supports a plurality of connector posts 203 together with a pair of spring contacts 204 and 205. Power unit 201 supports a plurality of conventional batteries 202 which by conventional wiring (not shown) are electrically coupled to spring contacts 204 and 205. Power unit 201 is assembled to connector pad 211 of light strip segment 210 by aligning posts 203 with sockets 207 and pressing power unit 201 onto connection pad 211. The alignment of posts 203 with sockets 207 ensures that spring contacts 204 and 205 of power unit 201 are aligned with spring contacts 214 and 215. Once power unit 201 is fitted to contact pad 211, the operation of light strip segment 210 is substantially identical to the operation of light strip segment 21 as a type one light strip segment.

What has been shown is a traffic control light strip which supports a plurality of light emitting diode illumination devices within a plurality of LED units upon an elongated supporting strip. A power and control unit responsive to operator inputs is operatively coupled to the LED units to provide selective illumination patterns of the light emitting diodes. The traffic control light strip is supported by a flexible elongated base member which allows the entire traffic control light strip to be rolled from a deployed configuration to a convenient storage configuration. In an alternate embodiment, the traffic control light strip includes a pair of extendable hinge coupled support members that facilitate folding the traffic control light strip to a closed transport and storage configuration.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A traffic control light strip comprising:

a first flexible light strip segment, having a first elongated body supporting a first plug connector at one end, a first connector receptacle at the remaining end, a first LED unit secured to said first elongated body and a connector pad;

a power and control unit, having an internal battery power supply, said power and control unit being removably attachable to said first elongated body;

electrical connection means operative between said power and control unit and said connector pad to apply power and control signals to said first LED unit;

a plurality of second flexible light strip segments each having a second elongated body supporting a second plug connector at one end, a second connector receptacle at the remaining end and a second LED unit secured to said second elongated body; and a third flexible light strip segment having a third elongated body supporting a third plug connection at one end, a third connector receptacle at the remaining end and a third LED unit, said plurality of second flexible light strip segments being serially joined by connecting of each second plug connectors to a respective one of said second connector receptacles and said first flexible light strip segment being joined to one of said second flexible light strip segments and said third flexible light strip segment being joined to one of said second flexible light strip segments whereby said first flexible light strip segment, said plurality of second flexible light strip segments and said third flexible light strip segment are serially joined to form a first traffic control light strip assembly.

2. The traffic control light strip set forth in claim 1 wherein said first, second and third elongated bodies are formed of a flexible material and wherein said light strip assembly may be rolled for storage and transport.

3. The traffic control strip set forth in claim 2 wherein said LED units each includes and supports a flexible vertically extending reflector formed of a flexible material which allows said reflect doors to fold against said first, second and third elongated bodies when said light strip assembly is rolled to its storage configuration.

4. The traffic control strip set forth in claim 3 further including a second traffic control light strip assembly, identical to said first traffic control light strip assembly, set wherein said first and second traffic control light strip assemblies may be serially coupled by joining said first plug connector of said first traffic control light strip assembly to a connector receptacle of said second traffic control light strip assembly.

5. A traffic control light strip having an elongated flexible body having first and second ends, a plurality of LED units ported upon said elongated flexible body, a connector pad formed on said elongated flexible body, and a power and control unit having an internal battery power supply together with operational control circuitry cooperating with said connector pad to attach said power and control unit to said connector pad, a first connector configured to provide mechanical and signal coupling to another traffic control light strip.

6. The traffic control light strip set forth in claim 5 wherein said traffic control light strip may be rolled to a storage and transport configuration upon a cooperating reel.

7. A traffic control light strip comprising:

a first light strip segment, having a first plurality of LED units supported thereon, defining a first end and a second end;

a second light strip segment, having a second plurality of LED units supported thereon, defining a third end and a fourth end;

a hinge pivotally coupling said second end of said first light strip segment to said forth end of said second light strip segment; and a power and control unit ported upon said third end and including a battery power supply and a control circuit for operating said first and second pluralities of LED units, said first and second light strip segments being pivotable about said hinge to configure said traffic control light strip in an open configuration in which said first and second light strip segments extend in generally opposite directions and a closed configuration in which said first and second light strip segments overlie each other.

8. The traffic control light strip set forth in claim 7 wherein said first and second light strip segments each include a pair of telescopically joined elements cooperating to either lengthen or shorten each of said first and second light strip segments.

9. The traffic control light strip set forth in claim 8 wherein said first end of said first light strip segment defines a curved lip portion having a concave surface for receiving a portion of said power and control unit when said traffic control strip is folded to its closed configuration.

10. The traffic control light strip set forth in claim 9 further including an LED work light supported upon said power and control unit.

11. A traffic control light strip as set forth in claim 10 further including a plurality of magnets ported upon said first and second light strip segments to facilitate attaching said traffic control light strip to a convenient metal surface.

12. A traffic control light strip comprising:

a plurality of elongated light strip segments each having a generally flat elongated body defining first and second ends, an LED unit supported upon said body, a first connector supported upon said first end and a second connector supported upon said second end;

a connection pad formed upon one of said elongated bodies; and a power and control unit, having an internal battery power supply and an LED unit signal controller, said internal battery power supply being operatively coupled to said LED units and said LED unit signal controller being operatively coupled to said LED units to control illumination thereof, said plurality of elongated light strip segments being capable of being rolled into a storage and transport configuration when not in use and extended to an unrolled configuration for deployment upon a roadway surface.

* * * * *